US012747073B2

(12) United States Patent
Wong et al.

(10) Patent No.: US 12,747,073 B2
(45) Date of Patent: Sep. 29, 2026

(54) LID ASSEMBLY

(71) Applicant: KING'S FLAIR MARKETING LIMITED, Tortola (VG)

(72) Inventors: Siu Wah Wong, Tortola (VG); Chi Yeung Chan, Tortola (VG); David Randall Knott, Tortola (VG); John Patrick Rose, Tortola (VG); Fat Sun Kwok, Tortola (VG); Ho Yan Leung, Tortola (VG); Tsan Ho Chan, Tortola (VG); Shun Sang Poon, Tortola (VG); Chun Na Wong, Tortola (VG)

(73) Assignee: KING'S FLAIR MARKETING LIMITED, Tortola (VG)

( * ) Notice: Subject to any disclaimer, the term of this patent is extended or adjusted under 35 U.S.C. 154(b) by 0 days.

(21) Appl. No.: 19/176,587

(22) Filed: Apr. 11, 2025

(65) Prior Publication Data

US 2025/0340341 A1 Nov. 6, 2025

Related U.S. Application Data

(60) Provisional application No. 63/642,195, filed on May 3, 2024.

(51) Int. Cl.
*B65D 47/08* (2006.01)
*B65D 51/18* (2006.01)

(52) U.S. Cl.
CPC ..... *B65D 47/0871* (2013.01); *B65D 47/0866* (2013.01); *B65D 47/0885* (2013.01);
(Continued)

(58) Field of Classification Search
CPC ..... B65D 51/18; B65D 43/22; B65D 43/02; B65D 43/0225; B65D 47/0857;
(Continued)

(56) References Cited

U.S. PATENT DOCUMENTS 9,282,838 B2 * 3/2016 Sims ..... B65D 47/32
2012/0261416 A1 * 10/2012 Lin ..... B65D 43/0229 220/253

(Continued)

*Primary Examiner* — Javier A Pagan
(74) *Attorney, Agent, or Firm* — WPAT, PC

(57) ABSTRACT

The present invention is related to a lid assembly, for a container, comprising: a base member, removably mounting to said container, having at least one engagement member and a passage fluidically communicable with an interior of said container, a top surface of said base member having a peripheral wall defining a receptacle thereon; a lid, the peripheral wall thereof having a first set of engagement members and a second set of engagement members; a ring member, movably mounting to said base member to move between a first position where said ring member engaging with said base member and a second position where said ring member disengaging with said base member, the peripheral wall of said ring member having at least one engagement member profiled for removably securing said lid inside a cavity of said ring member, wherein said lid being movable within said cavity via said second set of engagement members of said lid movably connecting to said engagement member of said ring member; and characterized in that: said lid assembly can be configured to assume a closed configuration where an ambient being not communicable with the interior of said container, in which: said ring member, with said lid, being at said first position and in said receptacle of said base member, wherein said first set of engagement members of said lid engaging with said engagement member of said base member, and said second set of engagement members of said lid engaging with said engagement member of said ring member; an open configuration where an ambient being communicable with the interior of said container, in which: said ring member, with said lid, being at said second position, wherein said first set of engagement members of said lid disengaging with said engagement member of said base member, and said second set of
(Continued)

engagement members of said lid engaging with said engagement member of said ring member; and in said open configuration, said lid can be removed from said ring member by positioning said second set of engagement members of said lid into a position where said second set of engagement members of said lid can be disengaged from said engagement member of said ring member.

13 Claims, 9 Drawing Sheets

(52) U.S. Cl.
CPC ..... *B65D 51/18* (2013.01); *B65D 2251/0025* (2013.01); *B65D 2251/0046* (2013.01); *B65D 2251/1058* (2013.01); *B65D 2251/1066* (2013.01); *B65D 2251/20* (2013.01)

(58) Field of Classification Search
CPC .... B65D 47/08; B65D 47/06; B65D 47/0871; B65D 47/0885; B65D 47/0866; B65D 55/02; B65D 53/02; B65D 41/04; B65D 2251/0025; B65D 2251/0046; B65D 2251/1058; B65D 2251/1066; B65D 2251/20; A47G 19/2266; A47G 19/2272
See application file for complete search history.

(56) References Cited

U.S. PATENT DOCUMENTS

| | | | | |
|---|---|---|---|---|
| 2017/0253389 | A1* | 9/2017 | Fogarty | B65D 47/265 |
| 2018/0177277 | A1* | 6/2018 | Dinata | B65D 41/04 |
| 2020/0391909 | A1* | 12/2020 | Pinelli | B65D 55/10 |
| 2023/0079738 | A1* | 3/2023 | Ni | B65D 43/26 220/315 |

* cited by examiner

LID ASSEMBLY

FIELD OF THE INVENTION

The present invention is related to a lid assembly. Specifically, the present invention is related to a lid assembly which has simplified design allowing all the components of the lid assembly that can be disassembled.

BACKGROUND OF THE INVENTION

Various drinking containers commonly found in the art typically consist of a container body and a lid secured to it. The lid includes a mechanism designed to open or close a liquid passage that connects an interior of the container body to the exterior. In some existing lid assemblies, they are designed structurally complex. As a result, the invention addresses the need for a simplified lid design featuring a spout that can allow quick and easy switching between the open and closed configuration of the lid assembly.

The present invention seeks to address issues of these mechanisms lack capability to adjust its resistance force and response time, or at least to provide an alternative to the public. In particular, the present invention provides an advantage that all the components of the lid assembly that can be disassembled for cleaning.

SUMMARY OF INVENTION

The first aspect of the present invention is related to a lid assembly, for a container, comprising: a base member, removably mounting to said container, having at least one engagement member and a passage fluidically communicable with an interior of said container, a top surface of said base member having a peripheral wall defining a receptacle thereon; a lid, the peripheral wall thereof having a first set of engagement members and a second set of engagement members; a ring member, movably mounting to said base member to move between a first position where said ring member engaging with said base member and a second position where said ring member disengaging with said base member, the peripheral wall of said ring member having at least one engagement member profiled for removably securing said lid inside a cavity of said ring member, wherein said lid being movable within said cavity via said second set of engagement members of said lid movably connecting to said engagement member of said ring member; and characterized in that:

said lid assembly can be configured to assume:

a closed configuration where an ambient being not communicable with the interior of said container, in which:

said ring member, with said lid, being at said first position and in said receptacle of said base member, wherein said first set of engagement members of said lid engaging with said engagement member of said base member, and said second set of engagement members of said lid engaging with said engagement member of said ring member;

an open configuration where the ambient being communicable with the interior of said container, in which:

said ring member, with said lid, being at said second position, wherein said first set of engagement members of said lid disengaging with said engagement member of said base member, and said second set of engagement members of said lid engaging with said engagement member of said ring member; and in said open configuration, said lid can be optionally removed from said ring member by positioning said second set of engagement members of said lid into a position where said second set of engagement members of said lid can be disengaged from said engagement member of said ring member.

In some embodiments, said engagement member of said base member being a protrusion extending inwardly from an inner side of said peripheral wall and being configured to be raised at a height with respect to said top surface of said base member; and said first set of engagement members of said lid including at least one first protrusion extending outwardly from the peripheral wall of said lid; and wherein in said closed configuration of said lid assembly, said first protrusion of said lid being retained in the cavity delimited by the raised height of said protrusion of said base member.

In some embodiments, in said open configuration of said lid assembly, said first protrusion of said lid being free from said cavity delimited by the raised height of said protrusion of said base member.

In some embodiments, said engagement member of said ring member being a groove having a first end and an opposing second end extending along an internal surface of said peripheral wall thereof; and said second set of engagement members of said lid including at least one second protrusion extending outwardly from the peripheral wall of said lid; and wherein the moving of said second protrusion of said lid in said groove of said ring member between said first end of said groove and said second end of said groove enabling the switching between said open configuration and said closed configuration of said lid assembly.

In some embodiments, the width of said groove of said ring member is larger or the same as the width of said second protrusion of said lid.

In some embodiments, said groove of said ring member being profiled as a T-shaped groove allowing said second protrusion of said lid moving therein; the horizontal portion of said T-shaped groove allowing the moving of said second protrusion of said lid between said first end of said T-shaped groove and said second end of said T-shaped groove; and at an intersection between said horizontal portion and the vertical portion of said T-shaped groove being provided with a first protrusion for supporting said second protrusion of said lid.

In some embodiments, said lid can be optionally removed from said ring member from a bottom side of said ring member when said second protrusion of said lid being positioned adjacent to said first protrusion of said T-shaped groove.

In some embodiments, said horizontal portion of said T-shaped groove being provided with a second protrusion adjacent to said first end of said T-shaped groove an/or a third protrusion adjacent to said second end of said T-shaped groove for maintaining the position of said second protrusion of said lid in said T-shaped groove.

In some embodiments, the length of said second protrusion of said lid is substantially the same as the following or smaller than the following:

the distance between said second protrusion of said T-shaped groove and said first end of said T-shaped groove, if said T-shaped groove being provided with said second protrusion; and/or the distance between said third protrusion of said T-shaped groove and said second end of said groove, if said T-shaped groove being provided with said third protrusion; and/or the distance between said second protrusion of said T-shaped groove and said third protrusion of said T-shaped groove, if said T-shaped groove being provided with said second protrusion and said third protrusion.

In some embodiments, said second protrusion and/or said third protrusion being a ramp.

In some embodiments, said ring member being configured to provide a clamp extending outwards from said peripheral wall thereof, and a thickness of said peripheral wall of said base member is sized and dimensioned fit to be received by said clamp.

In some embodiments, along a perimeter of said lid, the positions of said first protrusion of said lid and said second protrusion of said lid being offset.

In some embodiments, from a bottom to a top of said lid, said first protrusion of said lid being positioned lower than said second protrusion of said lid.

DESCRIPTION OF THE DRAWINGS

Some embodiments of the present invention will now be explained, with reference to the accompanied drawings, in which:—

DETAILED DESCRIPTION OF PREFERRED EMBODIMENTS OF THE INVENTION

Figure 1:
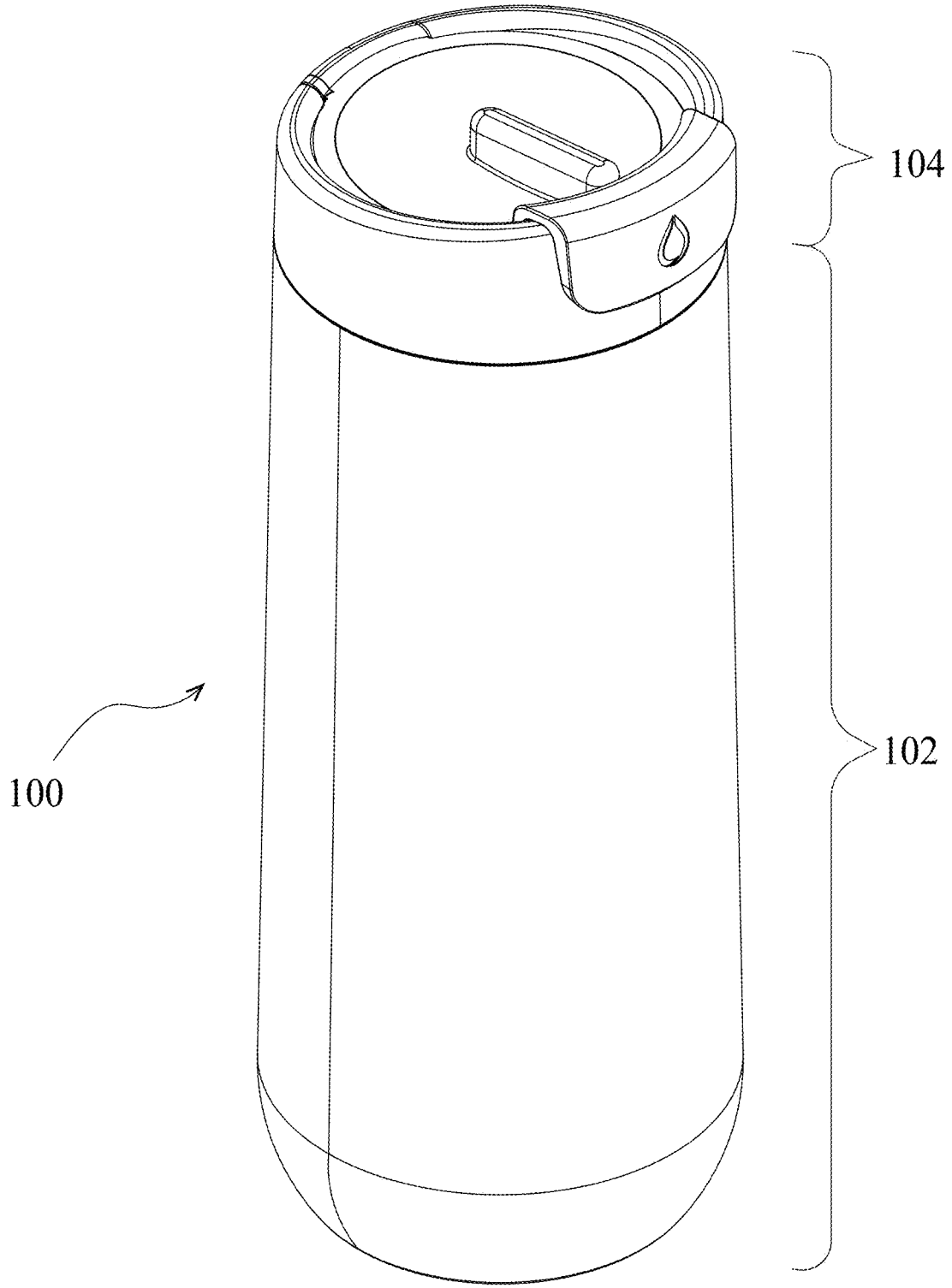
FIG. 1 is a perspective view of a bottle comprising a lid assembly of a first embodiment of the present invention and a container.

The present invention is now presented by way of examples with reference to the figures in the following paragraphs. Objects, features, and aspects of the present disclosure are disclosed in or are apparent from the following description. It shall be understood by one of ordinary skilled in the art that the following description is a description of exemplary embodiments only, and is not intended as limiting the broader aspects of the present disclosure, which broader aspects are embodied in the exemplary constructions.

It should be noted that, unless otherwise defined, the technical terms or scientific terms used in the embodiments of the present invention shall have the usual meanings understood by person with ordinary skills in the art to which the present invention belongs. "First", "second" and similar expression used in the embodiments of the present invention do not indicate any order, quantity or importance, but are only used to distinguish different components. "Front", "rear", "left", "right", "upper", and "lower" and other terms indicating orientation or similar terms are only described for the exemplary relative positional relationship shown in the drawings to facilitate the understanding. It does not limit the disclosed components in the present invention can only follow this specific relative positional relationship. "Connect or the like", "mount or the like" or "secure or the like" or "assemble or the like" is not limited to physical or mechanical connections, whether direct or indirect.

Referring now to the drawings, FIG. 1 illustrates a bottle 100 that comprises a container 102 and a lid assembly 104, which is a first embodiment of the present invention, placed thereon. The container 102 has a top opening; however, for clarity's sake it is not shown in the figures. The lid assembly 104 can be configured to connect to the container 102 for removably covering the top opening. The container 102 is used to contain or store contents such as beverage and may be of any type known liquid in the art.

Figure 2:
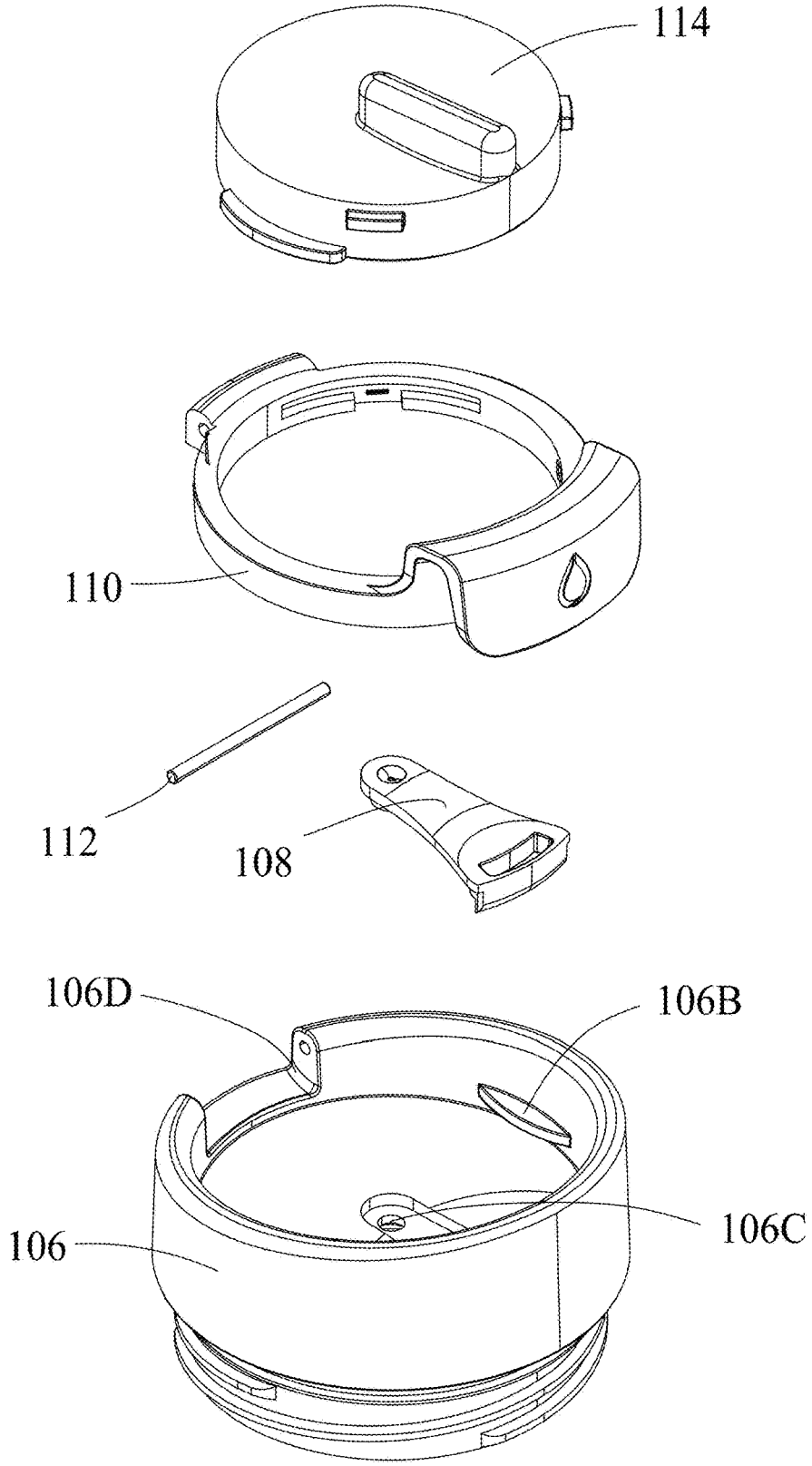
FIG. 2 is a perspective top view showing an exploded lid assembly of the first embodiment of the present invention.
Figure 3:
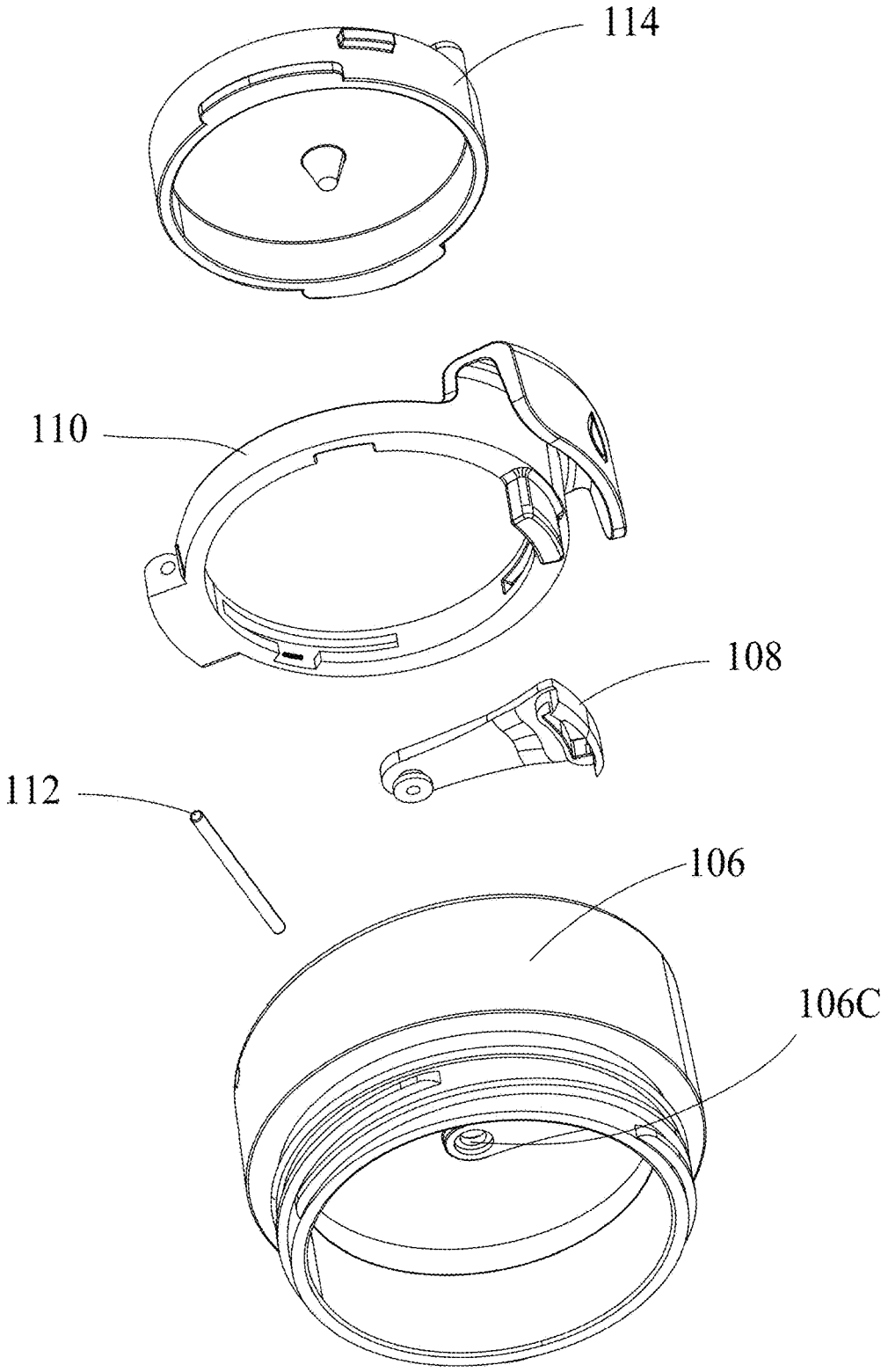
FIG. 3 is a perspective bottom view showing an exploded lid assembly of the first embodiment of the present invention.

FIGS. 2-3 are perspective views showing an exploded lid assembly 104. The lid assembly 104 comprises a base member 106, a seal 108, a ring member 110, an axle 112, a lid 114.

Figure 4A:
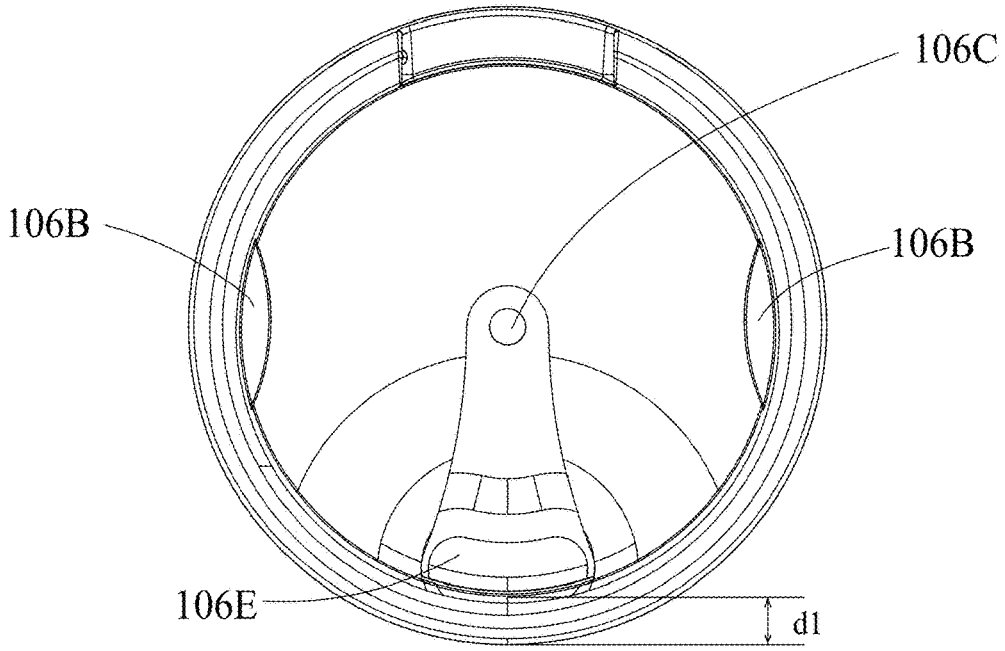
FIGS. 4A-4B are different views of a base member of the lid assembly of the first embodiment of the present invention.
Figure 4B:
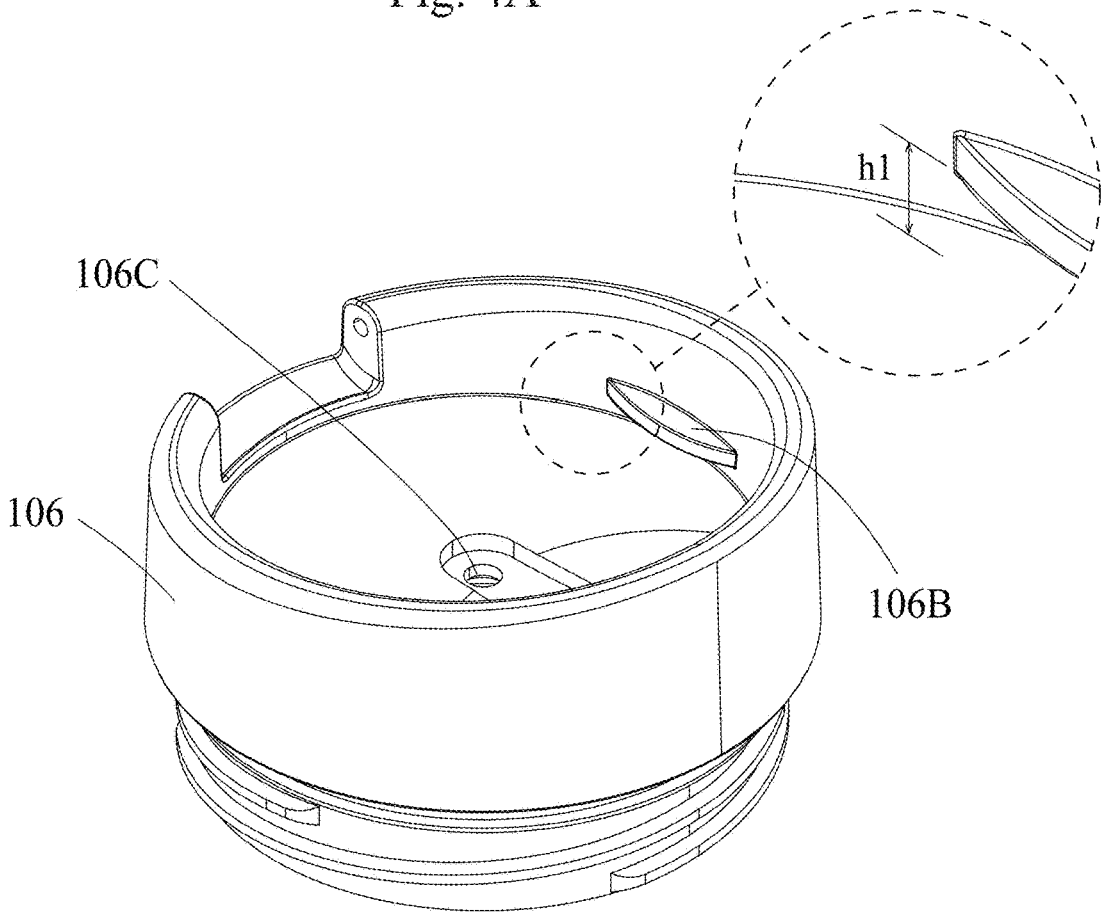

FIGS. 2-3, 4A and 4B show that the lower portion of the base member 106 is adapted to be removably attached to the opening of the container 102. For example, the lower portion of the base member 106 has internal threads formed on an inner surface thereof, which internal threads cooperate with external threads formed on an outer surface of the wall component of the container 102 to secure the lid assembly to the container. As shown, the upper portion of the base member 106, in particular the top surface of the base member 106 is profiled to provide a peripheral wall 106A that defines a receptacle on the top surface. The peripheral wall 106 is configured to provide at least one engagement member 106B. In FIGS. 2-3 and 4A-4B, the engagement member 106B of the base member 106 is in a form of protrusion or finger extending in a direction from the inner side of the peripheral wall 106A towards the center of the base member 106. Preferably, the engagement members 106B are in pair. More preferably, the engagement members 106B are oppositely facing. However, it shall not be construed as any limitation to the present invention. According to actual needs, the engagement member 106B could alternatively be a groove or other form, provided it can engage with a first set of engagement members of the lid, which will be explained in details hereafter. As shown in FIGS. 4A-4B, the peripheral wall 106A is provided with a pair of protrusions in meniscus shape oppositely facing to each other. The engagement member 106B is raised at height h1 with respect to the top surface of the base member (as indicated in FIG. 4B). The raised height allows the movement of the first set of engagement members of lid, which will be explained in details hereafter. The base member 106 is also configured to provide an air channel 106C and a passage 106E fluidically communicable with the interior of said container. Advantageously, the air channel 106C and the passage 106E are provided with the seal 108 that is preferably made of silicone to prevent leakage of fluid when the air channel 106C and the passage 106E are closed or specifically when the base member 106 is closed by the lid 114. The peripheral wall 106 is profiled to provide a notch thus providing two free ends 106D for the peripheral wall 106A. The two free ends 106D each is provided with an aperture for receiving the axle 112.

Figure 5B:
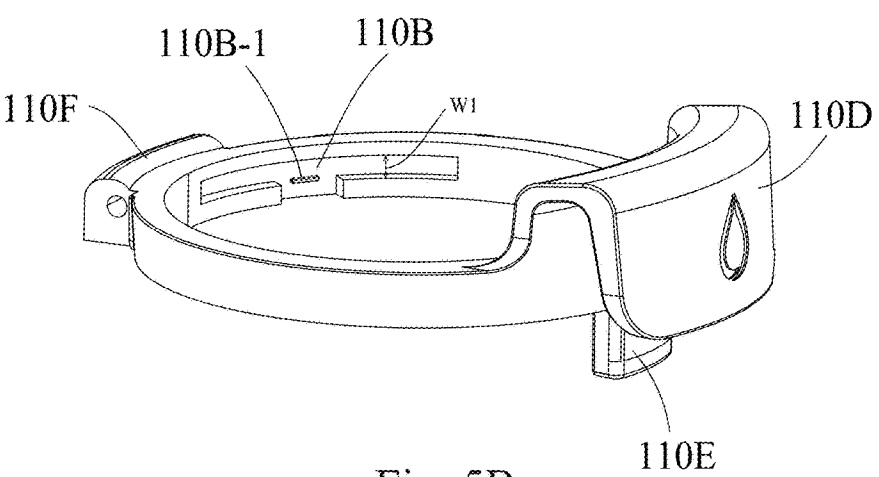
FIGS. 5A-5D are different views of a lid of the lid assembly of the first embodiment of the present invention.
Figure 5A:
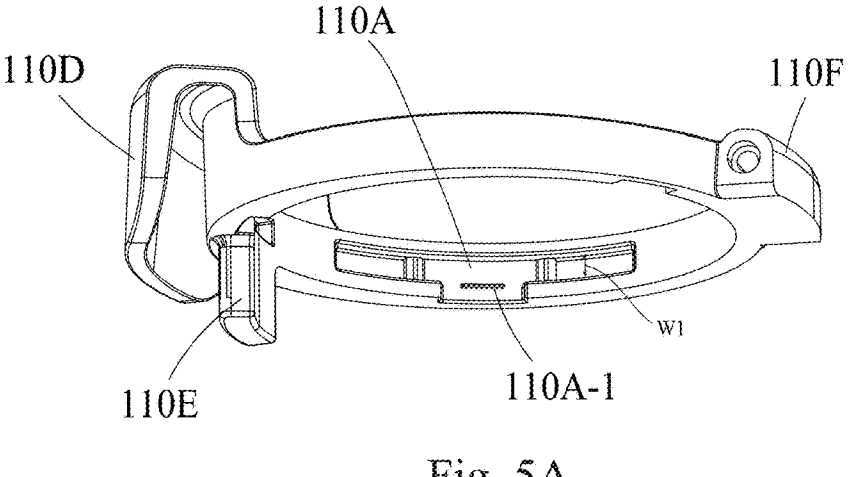
Figure 5D:
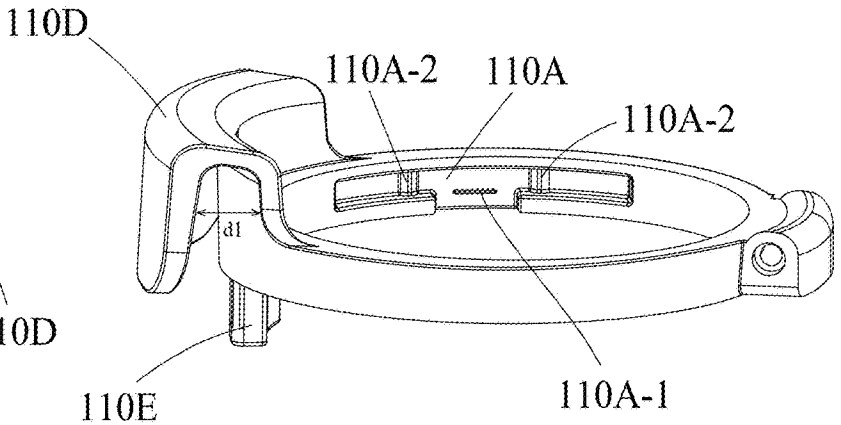
Figure 5C:
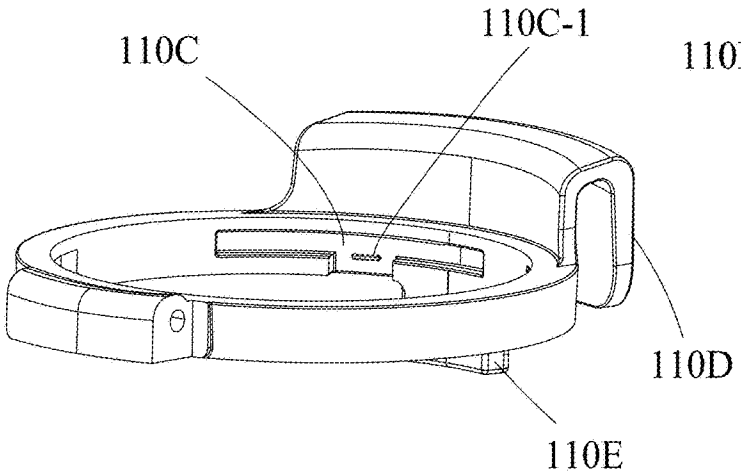

FIGS. 2-3 and 5A-5D illustrate that the ring member 110 is provided with three engagement members in the form of grooves on the internal surface of the ring member 110, namely first groove 110A, second groove 110B, and third groove 110C. The number of engagement members of the ring member in figures is an example only and shall not be construed as any limitation to the present invention. FIGS. 5A-5D show the contour of the first groove 110A, second groove 110B, and third groove 110C resembles a T-shape having a horizontal portion and a vertical portion. Advantageously, the width w1 of the horizontal portion of each of the first groove 110A, second groove 110B, and third groove 110C is approximately equal to the width of their engagement members of the second set of engagement members of the lid 114, which will be explained in details hereafter. To be more specific, width w1 can be dimensioned fit to receive the second set of engagement members of the lid 114. Using the first groove 110A as an example, along the horizontal portion of the T-shaped groove from one end to the other end, there is provided with a protrusion 110A-1 at a position proximate to the vertical portion of the T-shaped groove. Advantageously, the protrusion 110A-1 is made of a resilient material. As shown in FIGS. 5A-5D, each of the first groove 110A, second groove 110B, and third groove 110C is provided with the protrusion 110A-1, protrusion 110B-1, and protrusion 110C-1, respectively. Advantageously, FIG. 5D illustrates that two ramps 110A-2 are provided to the first groove 110A. Each ramp is positioned at each end of the protrusions 110A-1. This places the protrusion 110A-1 between the two ramps 110A-2. Although figures show that only groove 110A with two ramps 110A-2, these ramps can be similarly configured in other grooves of the ring member as needed. The ring member 110 is provided with a clamp 110D that extends upward from its top surface and then curves downward toward its bottom side. The configuration of the clamp 110D enables it to securely grip an object having thickness d1. Advantageously, the thickness of the peripheral wall 106A is approximately equal to thickness d1, as indicated in FIG. 2. The ring member 110 is also provided with a tooth member 110E on its bottom side, which is sized and shaped to fit into the passage 106E. In this specification, "bottom side of the ring member" refers to the side of the ring member that engages with the base member when the ring member 110 engages with the base member. The ring member 110 is also provided with a hinge-like structure 110F consisting of one cylindrical extension with holes, suggesting it is designed for rotational movement. Together with the two free ends 106D and the axle 112, the connection between the ring member 110 and the base member 106 is a pivotal connection, whereby the ring member 110 is movable between a first position where the ring member 110 engages with the base member 106 and a second position where the ring member 110 disengages from the base member 106. Advantageously, in said first position, the ring member 110 is received in the receptacle of the base member 106 defined by the peripheral wall 106A.

Figure 6A:
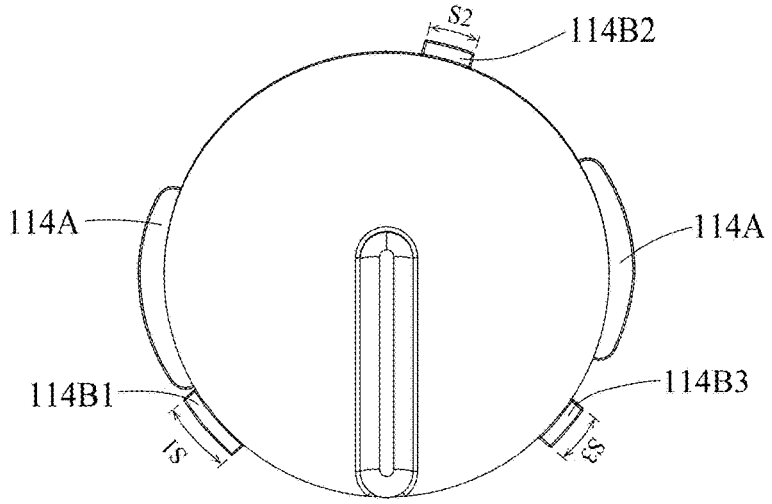
FIGS. 6A-6C are different views of a lid of the lid assembly of the first embodiment of the present invention.
Figure 6B:
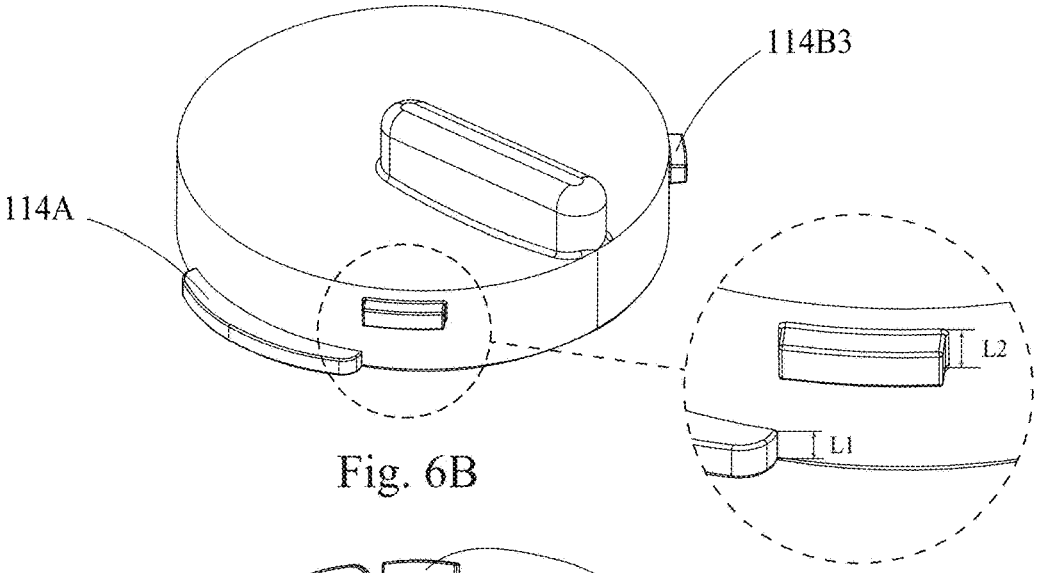
Figure 6C:
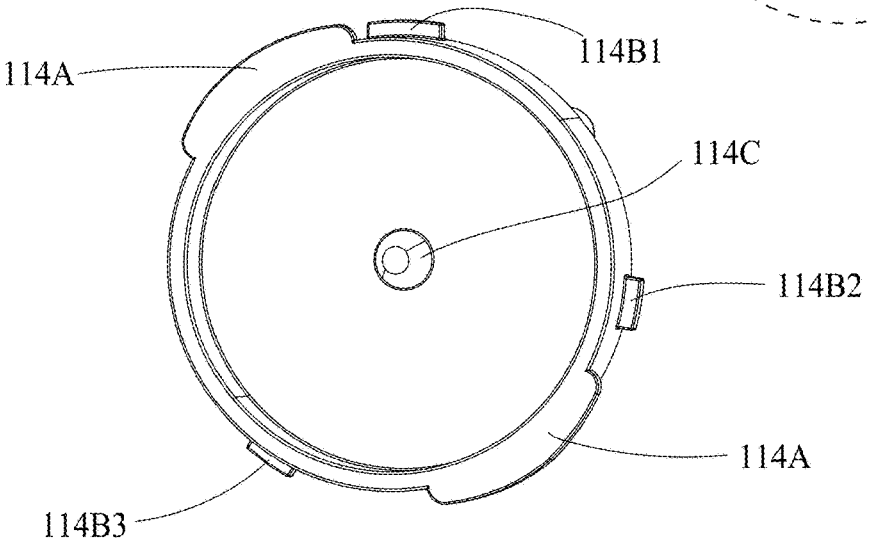

FIGS. 6A-6C show the outer perimeter of the lid 114 that includes the first set of engagement members 114A, in a form of protrusions, and the second set of engagement members 114B1, 114B2, and 114B3, in a form of protrusions. The number of engagement members shown in the figures is exemplary only. It can also be seen that, from the bottom to the top of the lid 114, the first set of engagement members 114A is positioned lower than the second set of engagement members 114B1-114B3. Moreover, along the perimeter of the lid 114, the positions of the first set of engagement members 114A and the second set of engagement members 114B1-114B3 are offset.

Advantageously, the number, the position, and the form of the engagement member of the base member, the engagement member of the ring member, the two sets of engagement members of the lid are complementary to each other. According to actual needs, variants of these components in figures could be configured based on the disclosures by those skilled in the art. For example, a groove in figures could be modified into a protrusion, or a protrusion in figures could be modified into a groove. In an example, when the first one of the second set of engagement members 114B1 sits in the groove 110A, the second one of the second set of engagement members 114B2 sits in the groove 110B, and the third one of the second set of engagement members 114B3 sits in the groove 110C, the lid 114 can still be held in position. In a further example, taking the first groove 110A and the first one of the second set of engagement members 114B1 as an example, when the first one of the second set of engagement members 114B1 is at either one of the two extreme ends of the groove 110A, the others of the second set of engagement members are also at one of the extreme ends of their respective grooves. As shown in FIG. 6B, the width of the first set of engagement members 114A and the second set of engagement members 114B1-114B3 are designated as L1 and L2, respectively. Advantageously, the width L1 (as shown FIG. 6B) of the first set of engagement members 114A is approximately the same as the raised height h1 of the engagement member 106B from the top surface of the base member. More advantageously, the raised height h1 of the engagement member 106B is equal to or greater than the width of said first set of engagement members 114A of said lid. Due to the complementary configurations of the first set of engagement members 114A of the lid 114 and the configuration of the engagement member 106B of the base member 106, the first set of engagement members 114A can slide in the spacing defined by the engagement member 106B and the top surface of the base member 106. Specifically, the lid 114 can rotate on the top surface of the base member with respect to the base member 106. More specifically, the lid 114 can rotate in the receptacle defined by the peripheral wall 106A and can rotate on the top surface of the base member with respect to the base member 106. Advantageously, the width L2 of the second set of engagement members 114B1-114B3 is approximately the same as the width w1 of the grove of the ring member 110. More advantageously, the width w1 of the grove of the ring member 110 is equal to or greater than the width of said set of engagement members of said lid. Due to the complementary configurations of the second set of engagement members 114B1-114B3 of the lid 114 and the configuration of the grooves of the ring member 110, the second set of engagement members 114B1-114B3 can slide smoothly within their respective grooves. In FIG. 6A, the lengths of the second set of engagement members 114B1-114B3 are designated as S1, S2, and S3, respectively. The "length" means the measurement of the second set of engagement members along the perimeter of the lid. In the first embodiment of the present invention, as shown in FIGS. 1-7, S1 is depicted as slightly longer than S2 and/or S3; however, this shall not be construed as a limitation of the present invention. With reference to this embodiment, it can be understood that the second set of engagement members 114B1-114B3 are adapted to fit into the three grooves 110A-110C, respectively. Again, this shall not be construed as a limitation of the present invention.

Due to the configurations of the T-shaped grooves and the second set of engagement members—particularly the presence of three protrusions 110A-1, 110B-1, and 110C-1, which support the second set of engagement members 114B1-114B3—it can be understood that, in an example where the lid 114 is positioned such that each of the second set of engagement members is aligned with the vertical portion of a corresponding T-shaped groove (for example, the first one of the second set of engagement members 114B1 with groove 110A, the second one of the second set of engagement members 114B2 with groove 110B, and the third one of the second set of engagement members 114B3 with groove 110C), the lid 114 can still be held in position. As a result, in this example, the lid 114 remains engaged with the ring member 110. However, when force is exerted on the top surface of the lid 114 in a direction from top to bottom, the second set of engagement members 114B1-114B3 slide over the protrusions 110A-1, 110B-1, and 110C-1, thereby exiting the vertical portions of the grooves of the ring member 110 along the vertical portions of the T-shaped grooves. Accordingly, the lid 114 can be disengaged from the ring member 110. Advantageously, the two ramps 110A-2 function as a lock or obstacle, preventing the second set of engagement members from easily leaving one extreme end due to unexpected sliding or unintentional rotation of the lid. More advantageously, the spacing defined between one extreme end and the ramp 110A-2 is approximately equal to the value of S1. Additionally, the spacing between the two ramps 110A-2 is also approximately equal to the value of S1. Most advantageously, the width of the vertical portions of the T-shaped grooves should be at least equal to, or greater than, the value of S1. One skilled in the art would understand that the reverse of the above-described process enables the assembly of the lid 114 onto the ring member 110. As shown in FIG. 6C, the bottom surface of the lid 114 is provided with a stopper 114C, preferably made of silicone or resilient member. The stopper 114C is sized and shaped fit to be received in the air channel 106C.

Figure 7A:
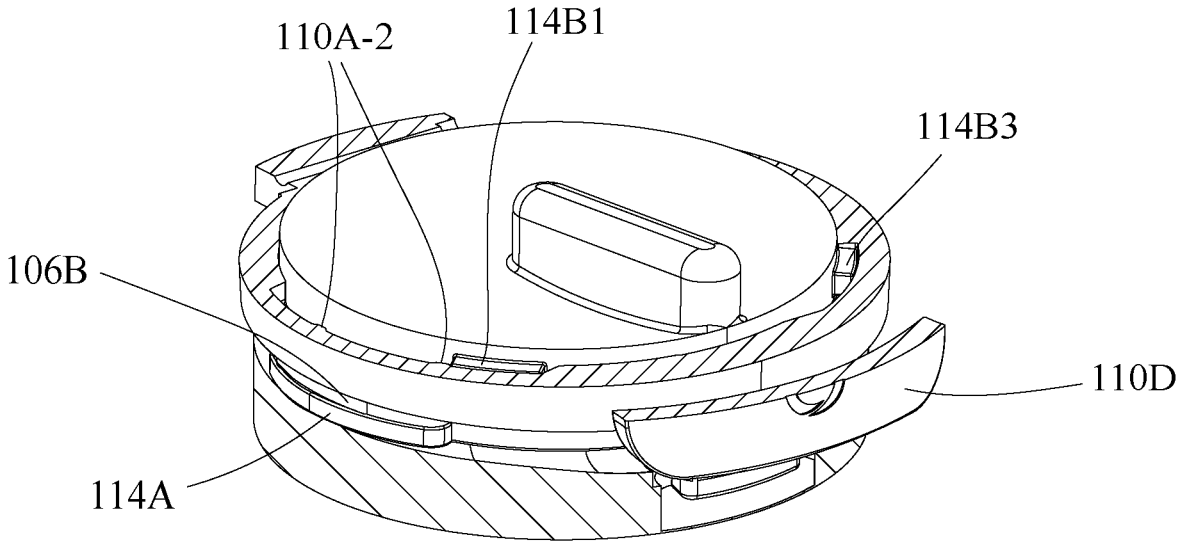
FIGS. 7A-7B are schematic drawings showing the operation of the lid assembly of the first embodiment of the present invention.
Figure 7B:
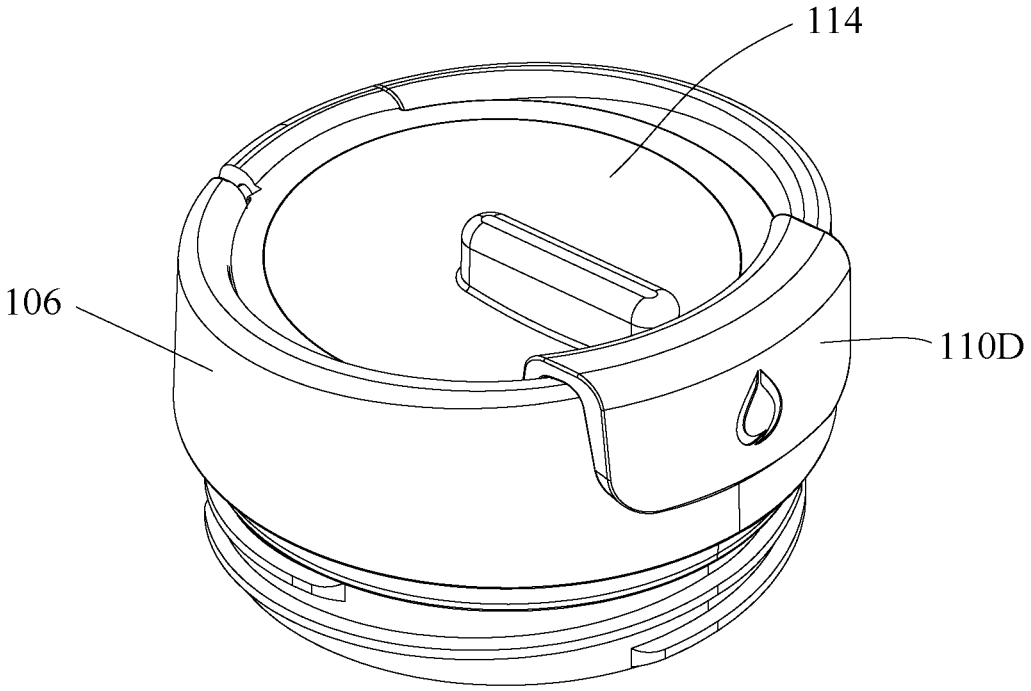

FIGS. 7A-7B show that the lid 114 is in a first position, resulting in the lid assembly being in a closed configuration. In this first position, the first set of engagement members 114A is positioned below the engagement member 106B, and the second set of engagement members, such as 114B1, is located at one extreme end of the groove 110A of the ring member 110. Specifically, in the closed configuration of the lid assembly, the first set of engagement members 114A is retained in a cavity defined by the raised portion of the engagement member 106B of the base member. In this configuration, the ring member 110, with the first set of engagement members 114A positioned below the engagement member 106B, is maintained in its first position.

Figure 8A:
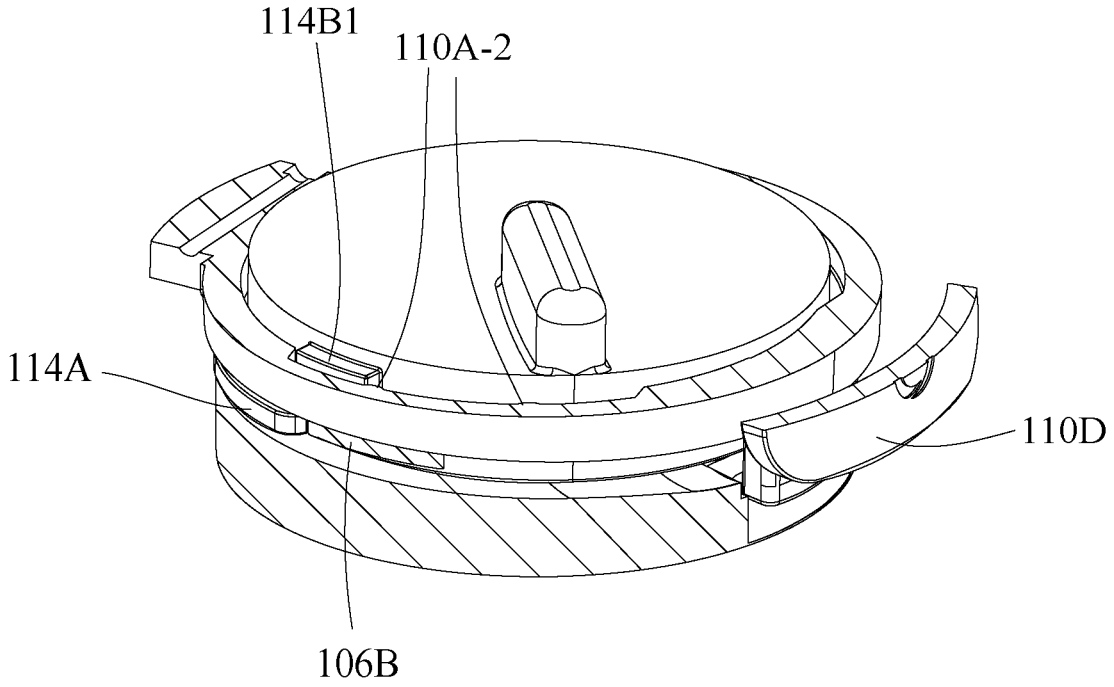
FIGS. 8A-8B are schematic drawings showing the operation of the lid assembly of the first embodiment of the present invention.
Figure 8B:
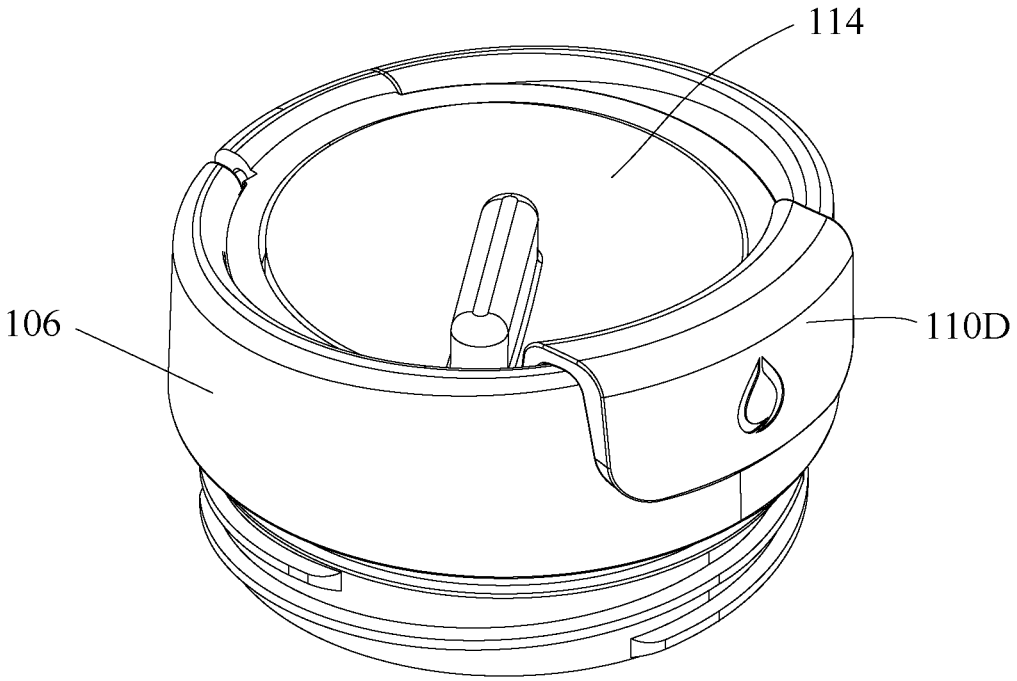

FIGS. 8A-8B show that the lid 114 is in a second position, resulting in the lid assembly being in a ready-to-open configuration. In this second position, the first set of engagement members 114A is offset from the engagement member 106B, and the second set of engagement members, such as the first one of the second set of engagement members 114B1, is at the opposite extreme end of the groove 110A of the ring member 110. In this ready-to-open configuration, the ring member 110, with the first set of engagement members 114A offset from the engagement member 106B, is ready to assume its second position as long as the user pivotally rotates the ring member 110 about the axle 112.

Figure 9A:
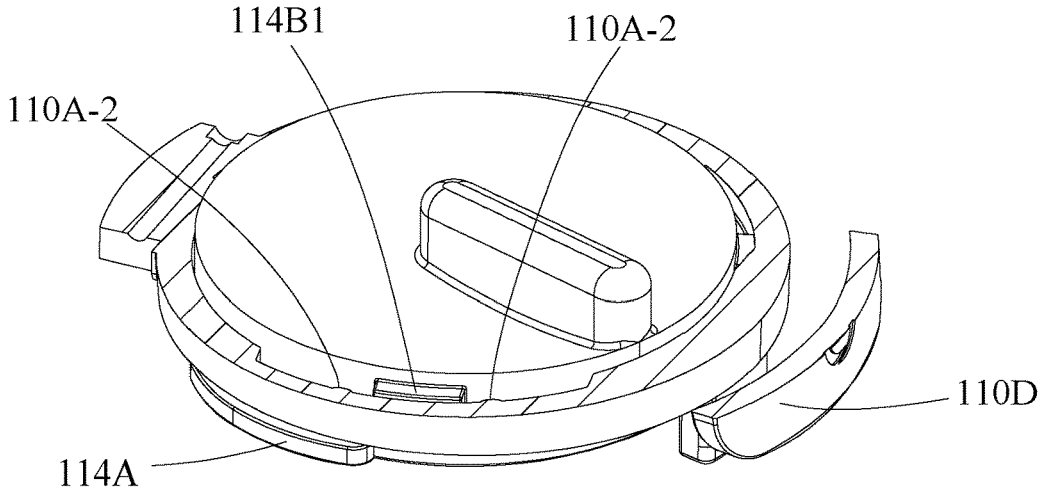
FIGS. 9A-9B are schematic drawings showing the operation of the lid assembly of the first embodiment of the present invention.
Figure 9B:
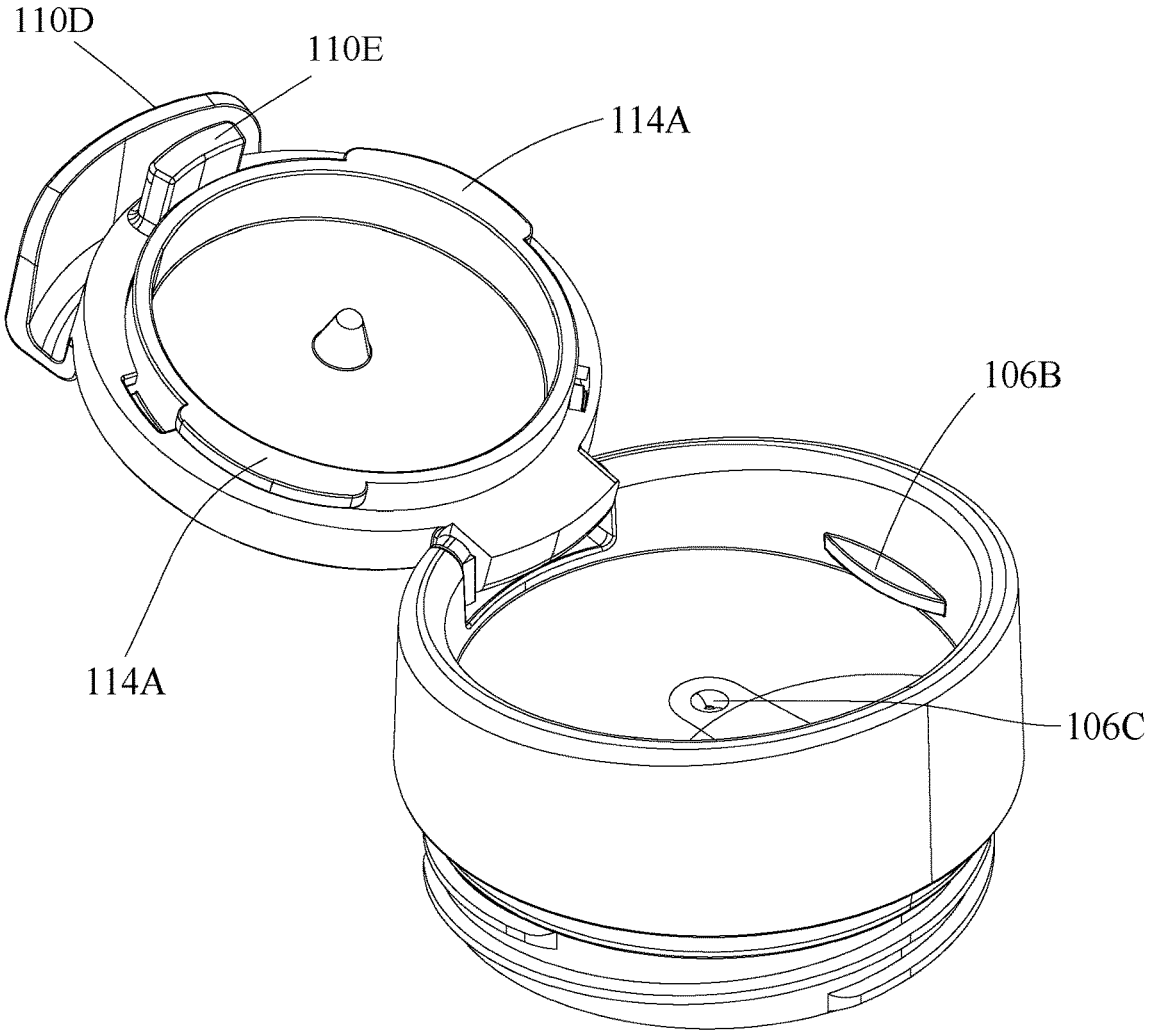

FIGS. 9A-9B show that the lid assembly is in an open configuration, in which users can drink the beverage contained in the container 102. In particular, the illustration in FIGS. 9A-9B show the ring member 110 in a third position, where the first one of the second set of engagement members 114B1 resides between the two ramps 110A-2. As a result, users are able to remove the lid 114 from the ring member 110 by, for example, sliding the first member of the second set of engagement members 114B1 over the protrusion 110A-1.

It shall be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. Also, a skilled person in the art would be aware of the prior art which is not explained in the above for brevity purpose. It is to be noted that certain features of the embodiments are illustrated by way of non-limiting examples. For example, the size and shape and position of the disclosed components can be adaptively changed to cater different users' need. The disclosed components are all examples to illustrate the present invention only and shall not construe as limiting to the scope of protection. Those skilled in the art could adjust and/or modify these components according to actual needs, and variations therefrom also fall into the scope of the present invention.

What is claimed is:

1. A lid assembly, for a container, comprising: a base member, removably mounting to said container, having at least one engagement member and a passage fluidically communicable with an interior of said container, a top surface of said base member having a peripheral wall defining a receptacle thereon; a lid, the peripheral wall thereof having a first set of engagement members and a second set of engagement members; a ring member, movably mounting to said base member to move between a first position where said ring member engaging with said base member and a second position where said ring member disengaging with said base member, the peripheral wall of said ring member having at least one engagement member profiled for removably securing said lid inside a cavity of said ring member, wherein said lid being movable within said cavity via said second set of engagement members of said lid movably connecting to said engagement member of said ring member; and characterized in that:

said lid assembly can be configured to assume:

a closed configuration where an ambient being not communicable with the interior of said container, in which:

said ring member, with said lid, being at said first position and in said receptacle of said base member, wherein said first set of engagement members of said lid engaging with said engagement member of said base member, and said second set of engagement members of said lid engaging with said engagement member of said ring member;

an open configuration where the ambient being communicable with the interior of said container, in which:

said ring member, with said lid, being at said second position, wherein said first set of engagement members of said lid disengaging with said engagement member of said base member, and said second set of engagement members of said lid engaging with said engagement member of said ring member; and in said open configuration, said lid can be removed from said ring member by positioning said second set of engagement members of said lid into a position where said second set of engagement members of said lid can be disengaged from said engagement member of said ring member.

2. The lid assembly according to claim 1, characterized in that said engagement member of said base member being a protrusion extending inwardly from an inner side of said peripheral wall and being configured to be raised at a height with respect to said top surface of said base member; and said first set of engagement members of said lid including at least one first protrusion extending outwardly from the peripheral wall of said lid; and wherein in said closed configuration of said lid assembly, said first protrusion of said lid being retained in the cavity delimited by the raised height of said protrusion of said base member.

3. The lid assembly according to claim 2, characterized in that in said open configuration of said lid assembly, said first protrusion of said lid being free from said cavity delimited by the raised height of said protrusion of said base member.

4. The lid assembly according to claim 1, characterized in that said engagement member of said ring member being a groove having a first end and an opposing second end extending along an internal surface of said peripheral wall thereof; and said second set of engagement members of said lid including at least one second protrusion extending outwardly from the peripheral wall of said lid; and wherein the moving of said second protrusion of said lid in said groove of said ring member between said first end of said groove and said second end of said groove enabling the switching between said open configuration and said closed configuration of said lid assembly.

5. The lid assembly according to claim 4, characterized in that the width of said groove of said ring member is larger or the same as the width of said second protrusion of said lid.

6. The lid assembly according to claim 4, characterized in that:

said groove of said ring member being profiled as a T-shaped groove allowing said second protrusion of said lid moving therein;

the horizontal portion of said T-shaped groove allowing the moving of said second protrusion of said lid between said first end of said T-shaped groove and said second end of said T-shaped groove; and at an intersection between said horizontal portion and the vertical portion of said T-shaped groove being provided with a first protrusion for supporting said second protrusion of said lid.

7. The lid assembly according to claim 6, characterized in that said lid can be removed from said ring member from a bottom side of said ring member when said second protrusion of said lid being positioned adjacent to said first protrusion of said T-shaped groove.

8. The lid assembly according to claim 6, characterized in that said horizontal portion of said T-shaped groove being provided with a second protrusion adjacent to said first end of said T-shaped groove and/or a third protrusion adjacent to said second end of said T-shaped groove for maintaining the position of said second protrusion of said lid in said T-shaped groove.

9. The lid assembly according to claim 8, characterized in that the length of said second protrusion of said lid is substantially the same as the following or smaller than the following:

the distance between said second protrusion of said T-shaped groove and said first end of said T-shaped groove, if said T-shaped groove being provided with said second protrusion; and/or the distance between said third protrusion of said T-shaped groove and said second end of said groove, if said T-shaped groove being provided with said third protrusion; and/or the distance between said second protrusion of said T-shaped groove and said third protrusion of said T-shaped groove, if said T-shaped groove being provided with said second protrusion and said third protrusion.

10. The lid assembly according to claim 8, characterized in that said second protrusion and/or said third protrusion being a ramp.

11. The lid assembly according to claim 8, characterized in that said ring member being configured to provide a clamp extending outwards from said peripheral wall thereof, and a thickness of said peripheral wall of said base member is sized and dimensioned fit to be received by said clamp.

12. The lid assembly according to claim 4, characterized in that along a perimeter of said lid, positions of said first protrusion of said lid and said second protrusion of said lid being offset.

13. The lid assembly according to claim 12, characterized in that from a bottom to a top of said lid, said first protrusion of said lid being positioned lower than said second protrusion of said lid.

* * * * *